US006016676A

United States Patent [19]

McConnell

[11] Patent Number: 6,016,676

[45] Date of Patent: Jan. 25, 2000

[54] UNIVERSAL FOB

[75] Inventor: John E. McConnell, Ann Arbor, Mich.

[73] Assignee: Lear Automotive Dearborn, Inc., Southfield, Mich.

[21] Appl. No.: 09/130,011

[22] Filed: Aug. 6, 1998

[51] Int. Cl.[7] ..... E05B 19/04

[52] U.S. Cl. ..... 70/408; 70/456 R; 70/395

[58] Field of Search ..... 70/408, 403, 405, 70/456 R, 395, 397, 278.3, 459

[56] References Cited

U.S. PATENT DOCUMENTS

| | | | |
|---|---|---|---|
| 3,729,965 | 5/1973 | Gartner | 70/408 |
| 4,349,975 | 9/1982 | Chubb | 70/330 |
| 4,888,970 | 12/1989 | Kinzler et al. | 70/408 |
| 4,901,548 | 2/1990 | DesLandes | 70/408 |
| 5,181,605 | 1/1993 | Bishop et al. | 70/456 R |
| 5,433,096 | 7/1995 | Janssen et al. | 70/278.3 |
| 5,561,331 | 10/1996 | Suyama et al. | 70/456 R |
| 5,737,951 | 4/1998 | Krass | 70/408 |
| 5,775,148 | 7/1998 | Layton et al. | 70/395 |
| 5,819,568 | 10/1998 | Christie et al. | 70/408 |

FOREIGN PATENT DOCUMENTS

| | | | |
|---|---|---|---|
| 85084 | 4/1965 | France | 70/395 |
| 404011178 | 1/1992 | Japan | 70/278.3 |
| 2039321 | 8/1980 | United Kingdom | 70/408 |

*Primary Examiner*—Darnell M. Boucher
*Attorney, Agent, or Firm*—Brooks & Kushman PC

[57] ABSTRACT

A universal key fob includes a housing to which is mountable one of a plurality of accessories. A key shank is mountable to the housing in order to provide a key head fob. A key ring is mountable to the housing in order to provide a key ring fob. Preferably, the accessories are connected to the housing via inserts which snap fit into a recess in the housing.

4 Claims, 2 Drawing Sheets

UNIVERSAL FOB

BACKGROUND OF THE INVENTION

Key fobs include user activatable buttons which operate various features of a vehicle remote keyless entry system. The key fobs are usually designed to include a key ring extending from the key fob housing. The key ring can be secured to a larger key ring and/or to keys, such as the key for the vehicle. In a key head fob design, a key shank is mounted directly to the key fob, such that the key fob and key shank are a single piece.

Some people prefer the key ring fob, so that other keys, trinkets and accessories can be attached. Other people prefer the key head fob, so that the key shank and fob are as compact as possible.

SUMMARY OF THE INVENTION

The present invention provides a universal key fob which can be assembled either as a key ring fob or key head fob. Thus, it is possible to provide either a key ring fob or a key head fob without the need for duplicating tooling and manufacturing equipment to manufacture an entirely new key fob or key fob housing.

Generally, the key fob housing includes a fastener which can be secured to one of any of a plurality of accessories, such as a key ring or key shank. Inserts which attach to the housing are each provided with different accessories. Preferably, a key shank insert and a key ring insert are provided.

In a preferred embodiment, the housing includes a recess for receiving one of a plurality of inserts. A key ring insert is molded having an integral loop that will accept a split ring. The key ring is insertable into the recess of the housing. Preferably a locking tab on the insert snap fits into a locking tab indent in the recess.

A shank insert defines a first aperture and an opposite second aperture at opposite ends of a passageway through the shank insert. A key shank is insertable through the second aperture and extends from the first aperture. The key shank insert is insertable into the recess in the housing, enclosing the second aperture and thereby securing the key shank to the housing. The key shank insert also preferably snap fits into the fob housing.

Other accessories, such as lights or trinkets may also be securable into the recess. Further, the housing may be provided with multiple recesses, in order to provide multiple options for securing different accessories to the fob housing.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DETAILED DESCRIPTION OF A PREFERRED EMBODIMENT

Figure 1:
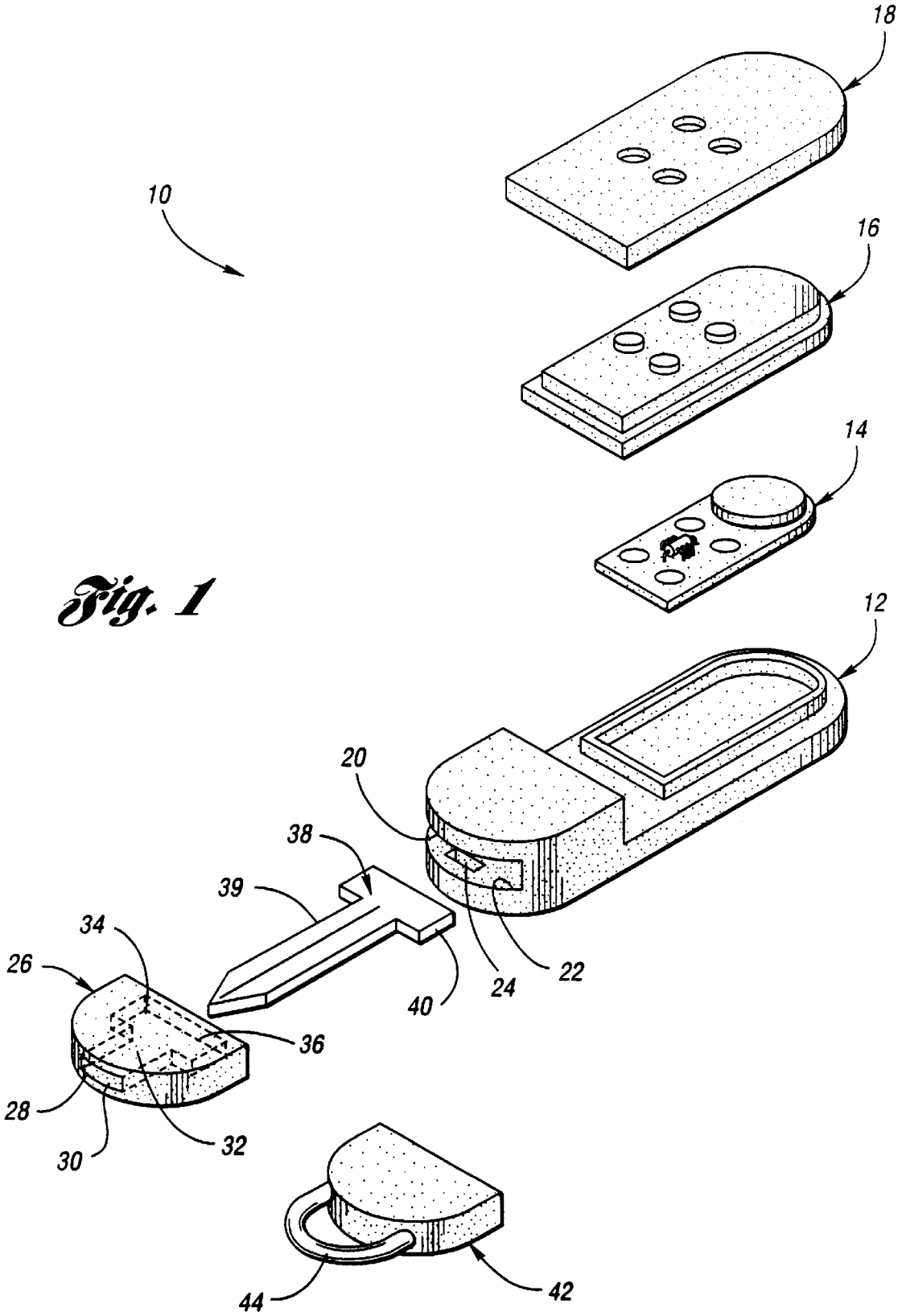
FIG. 1 is an exploded perspective view of the key fob of the present invention.
Figure 2:
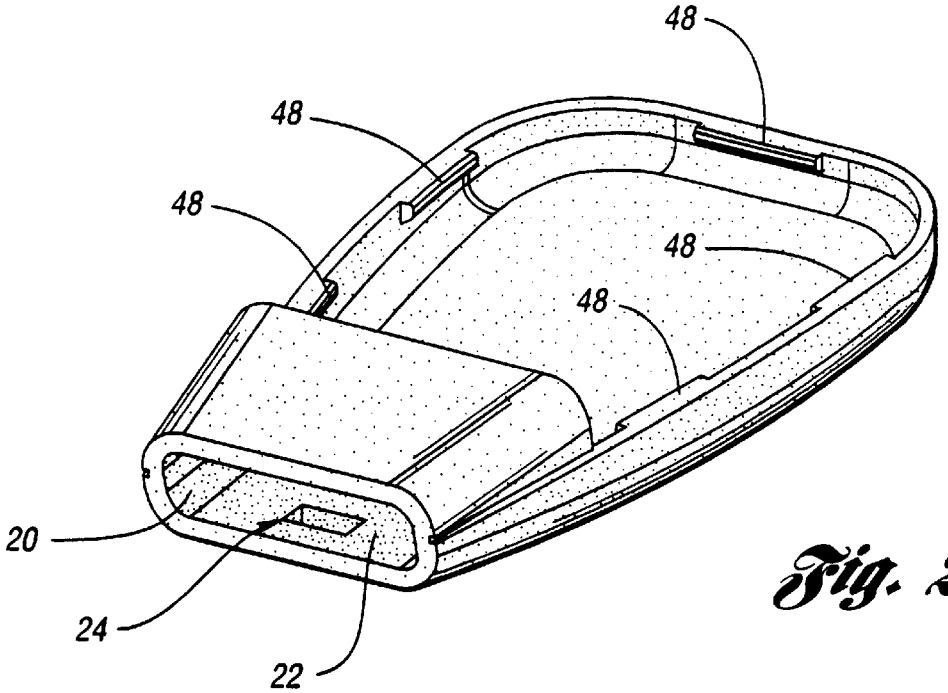
FIG. 2 is a perspective view showing the fob housing of FIG. 1 in detail.

An exploded perspective view of the universal key fob 10 of the present invention is shown in FIG. 1. The key fob 10 includes a fob housing 12 into which remote keyless entry circuitry 14 and corresponding user activatable key pads 16 are mounted. A cover 18 encloses the remote entry circuitry 14 and secures the key pad 16 to the fob housing 12. The remote entry circuitry 14, key pad 16 and cover 18 are generally as is known in the art. As is known, the remote entry circuitry 14 generates signals to activate or deactivate a remote entry system (not shown) based upon input from the key pads 16 activated by the user.

The fob housing 12 defines a recess 20 having a forward opening 22. An indentation 24 is formed on the surface of recess 20. Generally, as will be explained below, the recess 20 and indentation 24 form fasteners on fob housing 12.

A key shank insert 26 is shaped and sized to be generally complementary to recess 20. The key shank insert 26 and housing 12 generally comprise molded plastic of a type known and generally used for fob housings. The key shank insert 26 includes an axial passage 28. A first aperture 30 leads into a first portion 32 of the passage 28. The first portion 32 of passageway 28 is adjacent and continuous with a second portion 34, which is larger than the first portion 32. A second aperture 32 is defined adjacent the second portion 34.

A key shank 38, preferably metal, includes a narrow, elongated shank portion 39 into which teeth can be cut, and a shorter, wider head portion 40. The shank portion 39 is insertable through the passageway 28 in key shank insert 26.

A key ring insert 42, also of molded plastic, is also generally shaped and sized to fit within recess 20 of fob housing 12. The key ring insert 42 includes an integrally molded ring 44.

One of key shank insert 26 or key ring insert 42 is selectively inserted into the recess 20 of the fob housing 12. The key ring insert 42 also includes a locking tab (not shown) on the underside, which snap fits into indentation 24 in fob housing 12.

Figure 3:
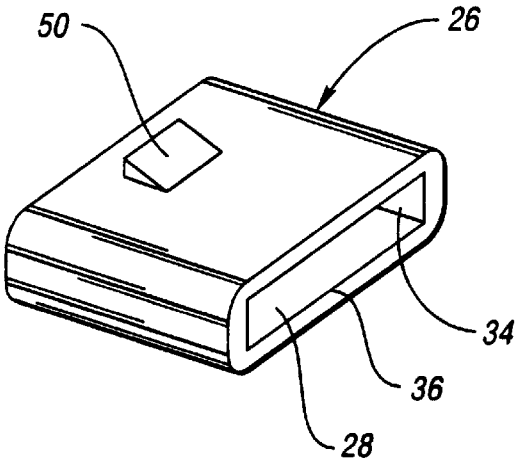
FIG. 3 is a different perspective view of the key shank insert of FIG. 1.

FIG. 3 is a perspective view of the underside (relative to FIG. 1) of the key shank insert 26. As can be seen in FIG. 3, key shank insert 26 includes a locking tab 50 complementary to the indentation 24 on the fob housing 12 (FIG. 1). The second aperture 36 leads into the second portion 34 of the passageway 28 in the key shank insert 26.

Figure 4:
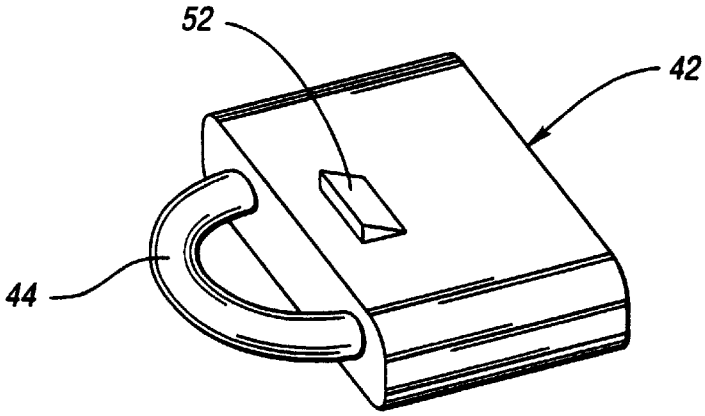
FIG. 4 is a different perspective view of the key ring insert of FIG. 1.

FIG. 4 is a perspective view of the underside (relative to FIG. 1) of the key ring insert 42. A locking tab 52 complementary to the indentation 24 in fob housing 12 (FIG. 1) is integrally molded in the key ring insert 42. The key ring 44 is also integrally molded with the key ring insert 42.

Referring to FIG. 1, during assembly of the key fob 10, the key fob 10 can be selectively assembled as a key head fob or key ring fob by selectively inserting key shank insert 26 or key ring insert 42, respectively, into recess 20 of fob housing 12. Thus, users can be provided with their preference without the need to mold and inventory multiple key fob housings 12. The remote entry circuitry 14, key pads 16 and cover 18 are then secured to fob housing 12.

If the key ring configuration is selected, the key ring insert 42 is snap-fit into the recess 20 of the fob housing 12. If the key head configuration is selected, teeth are cut in the shank portion 39 of the key shank 38, preferably prior to assembly. Then shank portion 39 is inserted through the second aperture 36, into passageway 28 and through first aperture 30, such that the shank portion 39 extends from the first aperture 30 of the key shank insert 26. The head portion 40 of the key shank 38 is disposed within the second portion 34 of the passageway 28 in the key shank insert 26. The key shank insert 26, together with the key shank 38, is then inserted into the recess 20 in the fob housing 12. A locking tab (not shown) on the underside of the key shank insert 26 snaps into the indentation 24 in the recess 20 of housing 12. The second aperture 36 is disposed within the fob housing 12, thus retaining the head portion 40 of the key shank 38 within the second portion 34 of the passageway 28.

Other accessories in addition to the key shank 38 and key ring 44 can also be provided. For example, other inserts could be made insertable into recess 20 of fob housing 12. Other inserts could provide other accessories, such as small flashlights or trinkets.

The fob housing 12 could also be provided with multiple recesses 20. Preferably, the fob housing 12 would include another recess 20 at the opposite end of the fob housing 12 extending in the opposite direction. Even more additional recesses 20 could be provided extending in other directions from the housing 12. In this way, different configurations of the key fob 10 could be provided with different accessories, each provided with a different insert.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A key fob for a vehicle remote keyless entry system, the key fob comprising:

a fob housing having a first fastener;

remote entry circuitry mounted in the fob housing; and a key shank insert and a key ring insert each including a second fastener complementary to the first fastener such that the key shank insert and the key ring insert are each selectively mountable to the fob housing, wherein either one, but not both, of the key shank insert and the key ring insert is mounted to the fob housing at one time, wherein the key shank insert includes a first aperture connected to a second aperture by a passageway, the second aperture being larger than the first aperture, the key shank insert further including a key shank having a shank portion and a larger head portion, the shank portion inserted through the second aperture and the passageway and extending from the first aperture, the head portion secured within the passageway.

2. The key fob of claim 1 wherein the key ring insert includes a key ring.

3. The key fob of claim 1 wherein the first fastener comprises a recess into which the key shank and key ring inserts are insertable.

4. The key fob of claim 1 wherein the first and second fasteners provide a snap-fit.

* * * * *